US011255291B2

(12) United States Patent
Steiner et al.

(10) Patent No.: US 11,255,291 B2
(45) Date of Patent: Feb. 22, 2022

(54) ENGINE COOLING ARRANGEMENT

(71) Applicant: Ford Global Technologies, LLC, Dearborn, MI (US)

(72) Inventors: Bernd Steiner, Duesseldorf (DE); Jan Mehring, Cologne (DE); Florian Huth, Cologne (DE); Klaus-Peter Heinig, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/923,605

(22) Filed: Jul. 8, 2020

(65) Prior Publication Data

US 2021/0010441 A1 Jan. 14, 2021

(30) Foreign Application Priority Data

Jul. 10, 2019 (DE) ..... 102019210203.4

(51) Int. Cl.

| | |
|---|---|
| ***F01P 3/02*** | (2006.01) |
| ***F02F 1/14*** | (2006.01) |
| ***F02F 1/16*** | (2006.01) |
| ***F02B 3/06*** | (2006.01) |
| *F02F 7/00* | (2006.01) |

(52) U.S. Cl.

CPC ..... *F02F 1/14* (2013.01); *F02B 3/06* (2013.01); *F02F 1/163* (2013.01); *F02F 2007/0063* (2013.01)

(58) Field of Classification Search

CPC .. F01P 3/02; F01P 2003/021; F01P 2003/028; F01P 2003/027; F02F 1/14; F02F 1/40; F02F 1/10

See application file for complete search history.

(56) References Cited

U.S. PATENT DOCUMENTS

| | | | | |
|---|---|---|---|---|
| 4,693,294 | A * | 9/1987 | Albrecht | B22C 9/10 164/312 |
| 5,558,048 | A | 9/1996 | Suzuki et al. | |
| 6,776,127 | B2 | 8/2004 | Osman | |
| 9,353,701 | B2 | 5/2016 | Yamamoto | |
| 2002/0121250 | A1 * | 9/2002 | Shimizu | B22C 9/108 123/41.28 |
| 2011/0023799 | A1 * | 2/2011 | Lenz | F01P 3/02 123/41.79 |
| 2013/0333658 | A1 * | 12/2013 | Yamamoto | F02F 1/10 123/195 R |

(Continued)

FOREIGN PATENT DOCUMENTS

| | | | | |
|---|---|---|---|---|
| DE | 4117112 | C1 * | 6/1992 | F02F 1/14 |
| DE | 102012200527 | A1 | 7/2013 | |

(Continued)

OTHER PUBLICATIONS

Google translation of DE4117112C1 (Year: 1992).*

*Primary Examiner* — Long T Tran

(74) *Attorney, Agent, or Firm* — Geoffrey Brumbaugh; McCoy Russell LLP

(57) ABSTRACT

Systems are provided for a cooling arrangement of an engine. In one example, a system includes a first coolant passage and a second coolant passage arranged in a cylinder bridge between directly adjacent cylinders, wherein the first coolant passage and the second coolant passage are separated from one another.

19 Claims, 5 Drawing Sheets

(56) References Cited

U.S. PATENT DOCUMENTS

| | | | | |
|---|---|---|---|---|
| 2015/0361862 | A1 | 12/2015 | Williams et al. | |
| 2016/0032814 | A1* | 2/2016 | Beyer | F02F 1/16 123/41.74 |
| 2016/0069248 | A1* | 3/2016 | Beyer | F01P 3/02 123/41.74 |
| 2016/0281583 | A1* | 9/2016 | Michikawauchi | F01P 3/02 |
| 2017/0152809 | A1 | 6/2017 | Wicks | |
| 2018/0306095 | A1* | 10/2018 | Steiner | F01P 7/165 |
| 2019/0301394 | A1* | 10/2019 | Knollmayr | F02F 1/40 |
| 2020/0088084 | A1* | 3/2020 | Kessens | F02F 1/40 |

FOREIGN PATENT DOCUMENTS

| | | | |
|---|---|---|---|
| JP | 2003120289 | A | 4/2003 |
| JP | 201708778 | A | 5/2017 |
| KR | 101274161 | B1 | 6/2013 |

* cited by examiner

ENGINE COOLING ARRANGEMENT

CROSS REFERENCE TO RELATED APPLICATIONS

The present application claims priority to German Patent Application No. 102019210203.4 filed on Jul. 10, 2019. The entire contents of the above-listed application is hereby incorporated by reference for all purposes.

FIELD

The present description relates generally to a cooling arrangement of two or more cylinders shaped via a cylinder head and a cylinder block.

BACKGROUND/SUMMARY

Internal combustion engines in motor vehicles, or motor vehicle engines, may comprise a cylinder block arrangement, in the case of which a cylinder head and a cylinder block shape one or more cylinders. It is additionally possible for sleeve-like inserts, so-called cylinder liners, to be provided in the cylinders. The narrow partition between two cylinders of a cylinder block is referred to as cylinder bridge, bore bridge, or cylinder web. The construction of cylinder blocks is becoming increasingly more compact, such that the specific loading in the individual regions of the component or of the assembly is also increasing. This in turn may result in higher temperatures in the affected region, and thus may lead to knocking and engine degradation once an upper threshold temperature is surpassed.

Increasing demands are therefore being placed on improved cooling. This applies in particular in a cylinder bridge or area between two cylinder liners, where the space for cooling is limited owing to the compact construction. A temperature hotspot, which should be avoided, may be present during operation in particular in the upper region of the cylinders or at the cylinder bridges, that is to say close to the cylinder head.

Various possibilities for cooling the region between two cylinders have been attempted.

For example, U.S. 2015/0361862A1 teaches a cooling arrangement of the cylinder bridge, in the case of which a portion of a water coolant channel in the cylinder head also flows through the cylinder bridge. This portion has a V shape, wherein both the inlet and the outlet for the coolant are situated on the top side of the cylinder bridge. Here, basically both symmetrical and asymmetrical embodiments are proposed.

In another example, U.S. Pat. No. 9,353,701 B2 also likewise presents two V-shaped line portions in the cylinder bridge, which line portions each conduct coolant from the water jacket through the cylinder bridge into the cylinder head. For this purpose, a pressure difference between the coolant in the cylinder head and the water jacket on the side of the cylinder block is generated in the cylinder bridge such that the coolant can circulate quickly.

In a further example, U.S. 2017/0152809 A1 has disclosed a cooling arrangement of the cylinder bridge, in the case of which the coolant channel is manufactured initially as a slot which is open to the top side of the cylinder bridge, which slot connects two regions of the coolant jacket to one another. The coolant channel is upwardly closed during the assembling of the assembly by a rib, which is complementary to the slot, on the bottom side of the cylinder head gasket or of the cylinder head.

In another further example, U.S. Pat. No. 6,776,127 B2 proposes two drilled water channels for the cooling of the cylinder bridge, which is divisible by a vertical axis into two regions. The water channels connect the water jacket to the top side of the cylinder bridge. Furthermore, the water channels run obliquely, in order that the lines pass the region of the temperature hotspot. An arrangement similar to this is disclosed in KR 10-1274161 B1, wherein, in said document, the two coolant channels cross or intersect, and are thus connected to one another in fluid-conducting fashion, centrally.

An overall disadvantage of the above configurations is that, with these, exclusively the upper region of the cylinder bridge, that is to say the portion in the region of the cylinder head or of the cylinder head gasket, is cooled.

In view of the previously examples above, the cooling arrangement in a cylinder block, in particular in the region of the cylinder bridge or between two cylinder liners, still has potential for improvements.

The disclosure is based on the object of providing a cooling arrangement of the cylinder block, in particular of the cylinder bridge or between two cylinder liners, which is improved in relation to the prior art, wherein it is simultaneously sought to reduce the costs for the production and assembling of the assembly.

According to the disclosure, the above issues are solved via an assembly comprising a cylinder head and a cylinder block of an internal combustion engine of a motor vehicle. The cylinder head and the cylinder block jointly form two or more cylinders, which are at least partially cooled via a cooling jacket arranged in the cylinder block of the internal combustion engine. The cylinders each comprise an upper region arranged in the cylinder head and a lower region situated below the upper region in the cylinder block. A cylinder bridge is arranged directly between two cylinders, wherein a first coolant channel is arranged in the upper region and a second coolant channel is arranged separately from the first coolant channel in the lower region.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
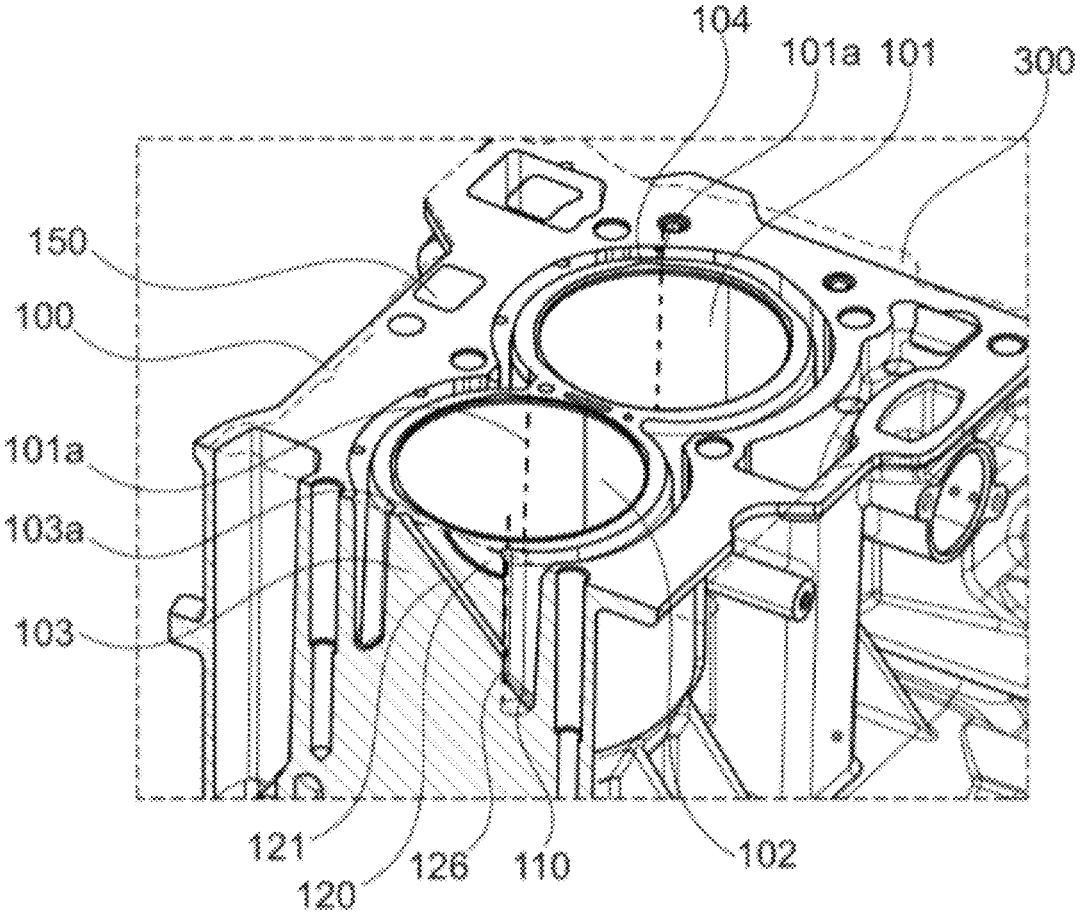
FIG. 1 shows a perspective sectional illustration of a first exemplary embodiment of a cylinder block according to the disclosure.

The following description relates to systems for an assembly having a cylinder head and having a cylinder block for an internal combustion engine of a motor vehicle, wherein the cylinder head and the cylinder block jointly form two or more cylinders, which are cooled by a single-part or multi-part cooling jacket of the assembly, with a coolant that can be caused to flow through the cooling jacket, of the internal combustion engine. Here, the cylinders each have an upper region, assigned to the cylinder head, and a lower region situated below said upper region. Furthermore, a cylinder bridge is provided between at least two mutually adjacently arranged cylinders. Within the cylinder bridge, at least one first coolant channel for the cooling of the cylinder bridge and/or of the cylinder liner by means of the coolant is provided in the upper region and/or at least one second coolant channel, which is formed preferably separately from the first coolant channel and which serves for the cooling of the cylinder bridge and/or of the cylinder liner by means of the coolant, is provided in the lower region.

"Formed separately" is defined as the coolant channels do not cross or intersect. The second coolant channel runs preferably at least in certain portions below the first coolant channel, such that the first coolant channel cools preferably the upper region of the cylinder and thus of the cylinder bridge and/or of the cylinder liner. At the same time, the second coolant channel thus cools the lower region of the cylinder and thus of the cylinder bridge and/or of the cylinder liner. In this way, both the cylinder bridge and the cylinder liner can be cooled over a region with a large area. The disclosure is suitable both for cylinder blocks with cylinders without cylinder liners and for cylinder blocks with cylinder liners. Therefore, the arrangement according to the disclosure of the coolant channels constitutes a major improvement in the cooling capacity, and offers a noticeable temperature reduction in the region of the cylinder bridge. It is thus furthermore possible for material to be saved, and for the costs for production and assembling of the assembly to be lowered.

In one optional configuration of the disclosure, the first coolant channel and the second coolant channel, configured to divert of coolant out of the cooling jacket, connect a coolant manifold of the cylinder head and the cooling jacket to one another.

It may thus be provided that the coolant in the internal combustion engine is initially conducted into the cooling jacket in the cylinder block. From there, the coolant flows through the cylinder bridge and through the first and the second coolant channels. Subsequently, the coolant from the two cooling channels is collected in a coolant manifold in the cylinder head and, from there, is conducted out of the internal combustion engine. The use of the coolant manifold in the cylinder head has a positive effect not only on the temperature in the cylinder bridge but also on the temperature in the cylinders, that is to say in the combustion chambers, in which a combustion process occurs.

In one example, the first coolant channel connects the upper region of the cooling jacket to the coolant manifold, and the second coolant channel connects the lower region of the cooling jacket to the coolant manifold of the cylinder head.

Thus, both the upper region and the lower region of the cylinder bridge and possibly of adjacent cylinder liners are cooled. In other words, the coolant channels have a first opening, assigned to the cooling jacket, and a second opening, assigned to the coolant manifold, on the top side of the cylinder bridge or the top side of the cylinder block. The coolant manifold is optionally directly at the opening at the top side of the cylinder bridge or the top side of the cylinder block.

In an optional refinement of the disclosure, a cylinder of the internal combustion engine has a cylinder axis, wherein an opening, assigned to the cooling jacket, of the second coolant channel and an opening, assigned to the cooling jacket, of the first coolant channel are arranged on a line, and wherein said line is oriented parallel to the cylinder axis. Preferably, the openings assigned to the cooling jacket are thus arranged one above the other and on the same side of the cylinder bridge in the cooling jacket. This arrangement of the coolant channels facilitates the flow guidance of the coolant and simplifies the manufacture of the coolant channels.

In a further embodiment of the disclosure, the second coolant channel is formed as an obliquely inclined passage bore. The second coolant channel may for example enclose an acute inclination angle, for example 30-60°, in particular 45°, relative to a cylinder axis along which a piston oscillates, and/or relative to a side wall of the coolant channel, and/or relative the top side of the cylinder bridge, and/or with the top side of the cylinder block.

In addition or alternatively, the first coolant channel may also be formed as an obliquely inclined passage bore. The inclination angle of the first coolant channel may vary relative to the inclination angle of the second coolant channel. The formation of the coolant channels as two passage bores permits straightforward production and results in improved strength of the cylinder bridge. In particular, even in the case of long-term loading, material fatigue can be avoided (improved HCF value).

In one example configuration of the disclosure, the first coolant channel is of slot-like form, formed as a cooling slot. The cooling slot is formed in particular as a groove which is partially open to the coolant manifold. The openings to the cooling jacket and to the coolant manifold are of narrow form, whereas the lateral walls of the slot or of the groove are configured with a large area. It is thus also possible for the cooling area with respect to the cylinders or the cylinder liners to be shaped to be large, and for the available coolant flow through the first coolant channel to be utilized efficiently. In the upper region, the cylinder bridge is also easily accessible for the manufacture of the cooling slot. For improved flow guidance of the coolant, the base wall of the cooling slot or of the groove is curved. It is therefore expedient if, during the manufacturing process, the cooling slot is produced using corresponding tools which can create a corresponding curvature of the base wall, wherein consideration may also be given to sawing tools.

The cylinder block is preferably manufactured entirely or partially from aluminum. The arrangement of the cooling channels is enhanced in particular in a cylinder block composed of aluminum, because overloading of the aluminum material can be mitigated in this way.

The use of a cylinder without a cylinder liner is likewise an embodiment of the disclosure. Instead, the aluminum block, in particular the cylinder, may be coated. Through the omission of the cylinder liner, the material in the cylinder block is duly initially additionally weakened. The increased cooling power that is thus desired in the region of the cylinder bridge can be provided via the design and arrangement according to the disclosure of the cooling channels.

In the different figures, identical parts are always provided with the same reference signs, for which reason these parts are generally also described only once.

FIG. 1 shows a cylinder block 100 which is illustrated in cutaway form in the region of a cylinder bridge 103. A cylinder head 200 (cf. FIG. 2) and the cylinder block 100 jointly form two or more cylinders 101 of the internal combustion engine which each have a cylinder axis 101*a* and which are delimited by the cylinder wall 102. In one example, a piston arranged in each of the two or more cylinders 101 is configured to oscillate alone the cylinder axis 101*a*. The cylinders 101 may further comprise inserted cylinder liners 104. Between two adjacent cylinders 101, there is provided a separating region or a partition, the so-called cylinder bridge 103. Since two combustion processes take place directly adjacent to this narrow region, the cooling of the cylinder bridge 103 is desired in order to mitigate overheating. For the cooling thereof, the cylinders 101 are surrounded by an encircling cooling jacket 110. The cooling jacket 110 may be produced during the casting of the cylinder block 100. A top side of the cylinder block 100 generally defines the planar cylinder block surface 150, which may be in contact with a bottom side of a cylinder head 200 (cf. FIG. 2) and/or of the cylinder head gasket 300 when the cylinder block 100 and the cylinder head 200 are connected. A narrow subsection of this cylinder block surface 150 forms the surface 103*a* of the cylinder bridge 103. According to the figure, for the cooling of the cylinder bridge 103 and of the adjacent cylinder liners 104 or cylinders 101, a first coolant channel 120 and at least one second coolant channel 121 which is formed separately from the first coolant channel 120 are arranged within the cylinder bridge 103.

In one example, the engine of FIG. 1 comprises greater than two cylinders. The cutaway illustrated in FIG. 1 is taken along a region between two adjacent cylinders, thereby exposing the cylinder bridge 103. For example, the engine is an I-3 engine, wherein a third cylinder of the engine is omitted from FIG. 1.

Figure 2:
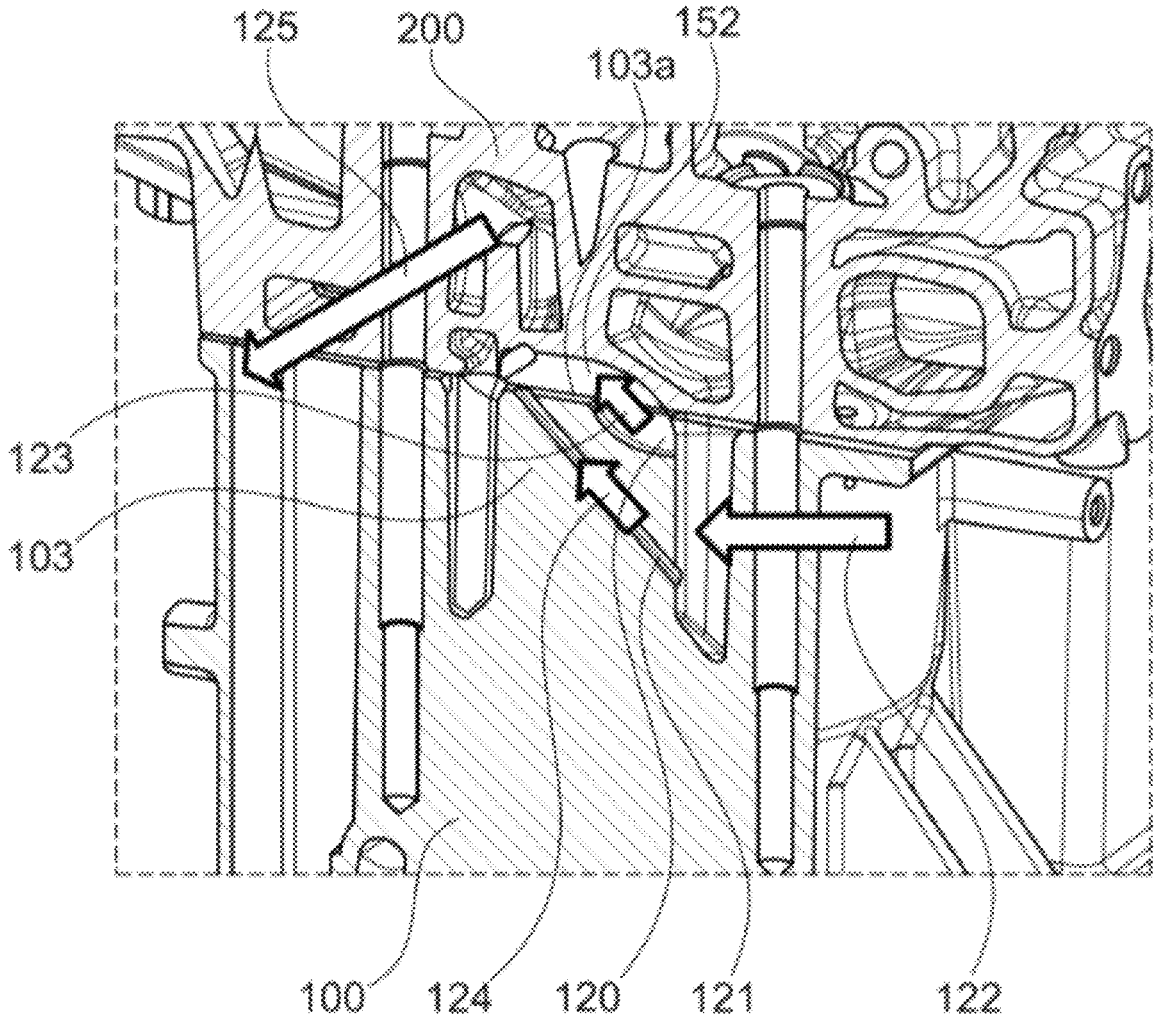
FIG. 2 shows a perspective sectional illustration of the first exemplary embodiment of an assembly according to the disclosure.

FIG. 2 indicates, via the arrows 122-125, a possible course of the flow of the coolant. The first coolant channel 120 and the second coolant channel 121 connect a coolant manifold 152 in the cylinder head 200 and the cooling jacket 110 to one another. Firstly, during the feed of coolant 122, the coolant is fed to the cooling jacket 110 from the cylinder block 100. The opening, assigned to the cooling jacket 110, of the first coolant channel 120 and the opening, assigned to the cooling jacket 110, of the second coolant channel 121 are thus formed as coolant inlet 120*a*, 121*a* (cf. FIG. 3*a*). They allow a first passage of coolant 123 from the upper region 103*o* (cf. FIG. 5*b*) of the cooling jacket 110 through the first coolant channel 120 and a second passage of coolant 124 from the lower region 103*u* (cf. FIG. 5*b*) of the cooling jacket 110 through the second coolant channel 121. That is to say, a first coolant inlet 120*a* may be configured to flow coolant from the cooling jacket 110 to the first coolant channel 120. The second coolant inlet 121*a* may be configured to flow coolant from the coolant jacket 110 to the second coolant channel 121. The opening, assigned to the coolant manifold 152, of the first coolant channel 120 and the opening, assigned to the coolant manifold 152, of the second coolant channel 121 are thus formed as coolant outlet 120*b*, 121*b* (cf. FIG. 3*a*). That is to say, the first coolant channel 120 may feed coolant to the coolant manifold 152 via a first coolant outlet 120*b* and the second coolant channel 121 may feed coolant to the coolant manifold 152 via a second coolant outlet 121*b*. The coolant emerges at the top side 103*a* of the cylinder bridge 103. Downstream of the coolant outlet 120*b*, 121*b*, the coolant is merged in the coolant manifold 152 in the cylinder head 200 and is conducted out by way of a discharge of coolant 125. Thus, while the first coolant channel 120, formed for example as a cooling slot, cools the upper region 103*o* (cf. FIG. 5*b*) of the cylinder bridge 103, the second coolant channel 121 cools the lower region 103*u* (cf. FIG. 5*b*) of the cylinder bridge 103.

In this way, the first coolant channel 120 and the second coolant channel 121 are completely separated from one another. Coolant in the first coolant channel 120 does not mix with coolant in the second coolant channel 121. Each of the first coolant channel 120 and the second coolant channel 121 receive coolant from the cooling jacket 110 and dispense coolant into the coolant manifold 152.

Figure 3A:
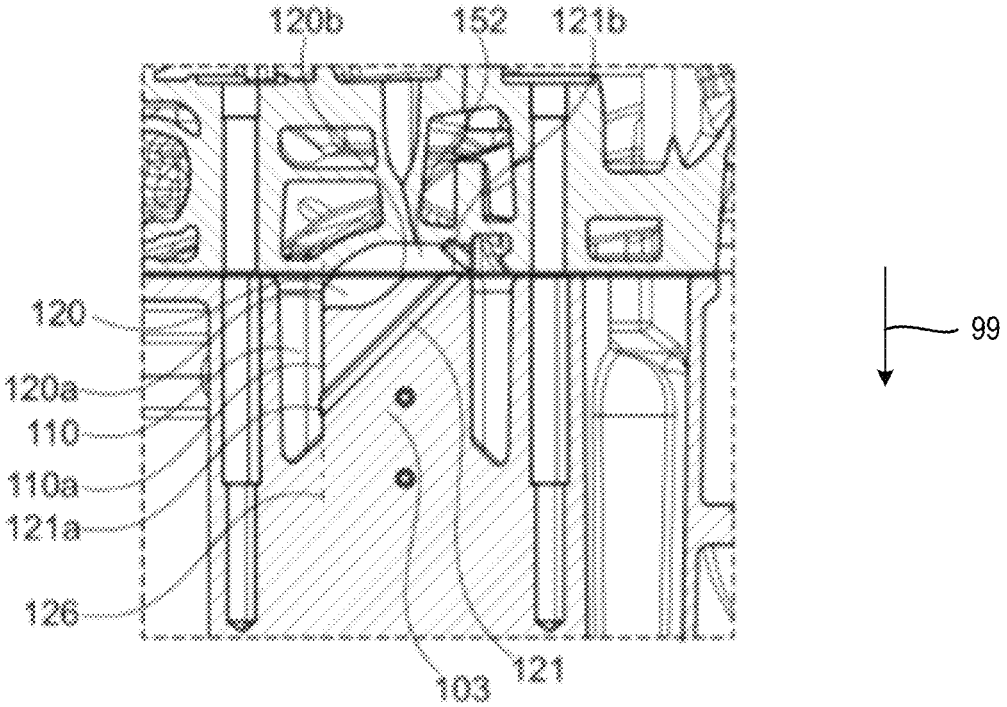
FIG. 3A shows a front view of a sectional illustration of the first exemplary embodiment of an assembly according to the disclosure.

FIG. 3*a* shows an embodiment as per FIG. 2, the illustration of which has however been substantially tilted. A line 126 is shown which runs along a side wall 110*a* of the cooling jacket 110 and which is oriented substantially parallel to at least one cylinder axis 101*a* (cf. FIG. 1). The inlet opening 120*a* of the first coolant channel 120 is arranged above the inlet opening 121*a* of the second coolant channel 121 along said line 126 relative to a direction of gravity (arrow 99). Thus, the second coolant channel 121 runs at least in certain portions below the first coolant channel 120. In other words, at least two cylinder axes 101*a* (cf. FIG. 1) may span a plane, wherein the inlet openings 120*a*, 121*a* of the cooling channels 120, 121 are arranged on the same side of said plane. The arrangements of the inlet openings 120*a*, 121*a* for example on a conical or domed side wall 110*a* of the cooling jacket 110 may be included in some embodiments. This means that the side wall 110*a* thus does not run parallel to a cylinder axis 101*a*, but is for example arranged in an obliquely inclined manner in some embodiments. In one example, the inlet openings 120*a*, 121*a* are thus situated on the same side of the cylinder bridge 103 in the cooling jacket 110, that is to say are not situated opposite one another. The first coolant channel 120 is formed as a cooling slot, whereas the second coolant channel 121 constitutes a passage bore. In one example, the passage bore is narrower than the slot, and wherein the passage bore bored through an entire material of the cylinder block 100 while the slot is carved out of the material. In accordance with the exemplary coolant flow 122-125 (cf. FIG. 2) described above, the inlet opening 120*a*, 121*a* is arranged below the outlet opening 120*b*, 121*b*. The coolant channels 120, 121 are thus formed as riser lines, wherein coolant flowing therethrough flows at least partially against the direction of gravity. In the case of the first coolant channel 120, the gradient is realized by virtue of the base wall of the cooling slot having a curvature which leads to the coolant manifold 152. In the case of the second coolant channel 121, the gradient is realized by virtue of the central axis of the passage bore having an angle of for example 45° relative to a top side 103*a* of the cylinder bridge 103 and/or relative to a cylinder axis 101*a*.

Figure 3B:
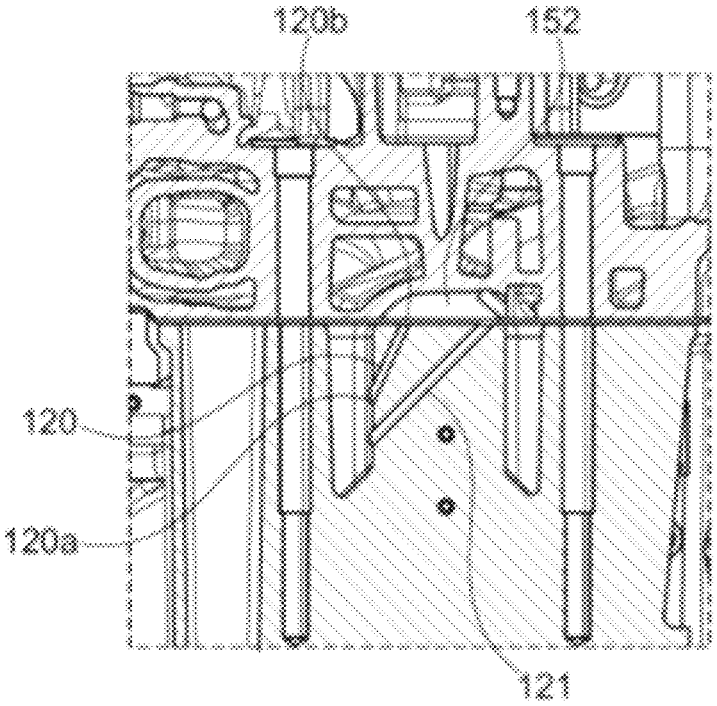
FIG. 3B shows a front view of a sectional illustration of a second exemplary embodiment of an assembly according to the disclosure.

Alternatively, in a second exemplary embodiment as per FIG. 3*b*, it is also possible for the first coolant channel 120 to be manufactured as a passage bore. Both passage bores of the cylinder bridge 103 have an opening, in particular a coolant outlet 120*b*, 121*b*, to the coolant manifold 152. In this case, in the case of the second coolant channel 121, the gradient is likewise realized by virtue of the central axis of the passage bore having an angle relative to a top side 103*a* of the cylinder bridge 103 and/or relative to a cylinder axis

101*a*. Such an acute angle may for example enclose 60° with the top side 103*a* of the cylinder bridge 103. The first coolant channel 120 is thus preferably oriented more steeply than the second coolant channel 121. That is to say, the first coolant channel 120 may be arranged such that coolant therein flows against the direction of gravity more than coolant in the second coolant channel 121.

Said another way, the first coolant channel 120 may be shaped to more quickly direct coolant from the coolant jacket 110 to the coolant manifold 152 than the second coolant channel 121. As such, coolant in the first coolant channel 120 may flow along less of a diameter of the cylinders than coolant in the second coolant channel 121. In one example, coolant in the second coolant channel 121 may flow across a majority of the diameter of the cylinders before reaching the coolant manifold 152 in the cylinder head 200. In this way, the first coolant channel 120 may comprise a more acute angle or more severely curved surface than the second coolant channel 121, wherein the angle is measured relative to a direction of gravity or a central axis of the piston (e.g., piston axis 101*a*). Additionally or alternatively, a length of the first coolant channel 120 is less than a length of the second coolant channel 121.

Figure 4A:
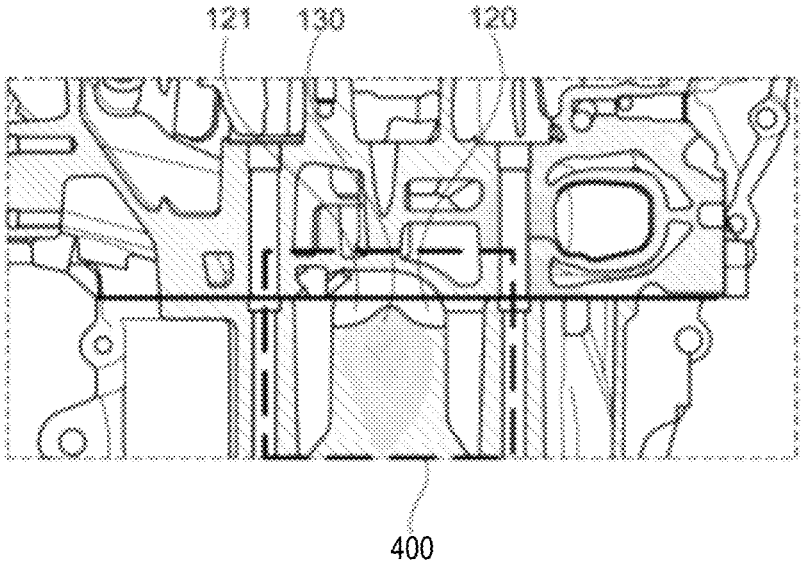
FIG. 4A shows a front view of a sectional illustration with temperature profile of a third exemplary embodiment of an assembly according to the disclosure.
Figure 4B:
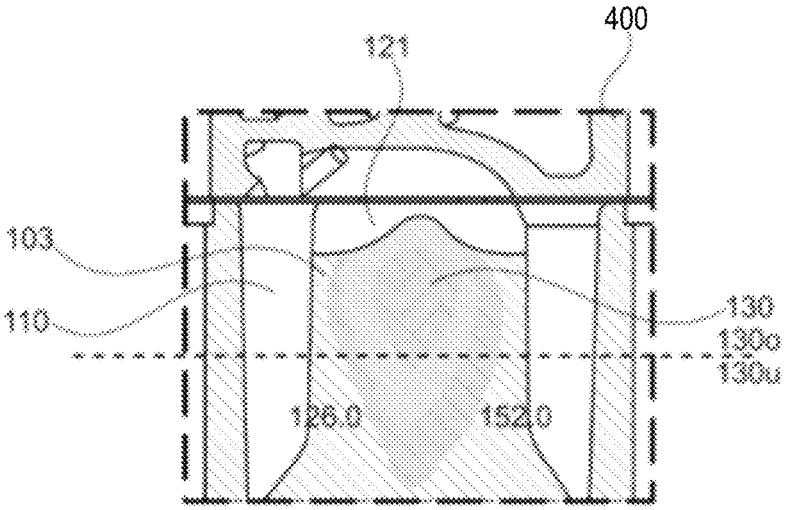
FIG. 4B shows an enlarged detail from FIG. 4*a;*

Turning to FIG. 4*a*, a third exemplary embodiment according to the disclosure is shown, the first coolant channel 120 and the second coolant channel 121 are both arranged, as cooling slots, in the upper region 103*o*. FIG. 4*b* shows an enlarged detail 400 from FIG. 4*a*. The cylinders 101 and thus also the cooling jacket 110, any cylinder liners 104 and cylinder bridges 103 can, on the basis of an imaginary plane depicted by way of example, be divided into an upper region 103*o* and a lower region 103*u*. Owing to the combustion process in the adjacent cylinders 101 (cf. FIG. 1), elevated temperatures also arise in the cylinder bridge 103. The cooling jacket 110 and the coolant channels 120, 121 block the temperature in the metal or aluminum from increasing beyond an upper threshold temperature, above which degradation due to thermal stress may begin to occur. A temperature hotspot 130 of for example 200° C. may occur here predominantly in the upper region 103*o* of the cylinder bridge 103.

Figure 5A:
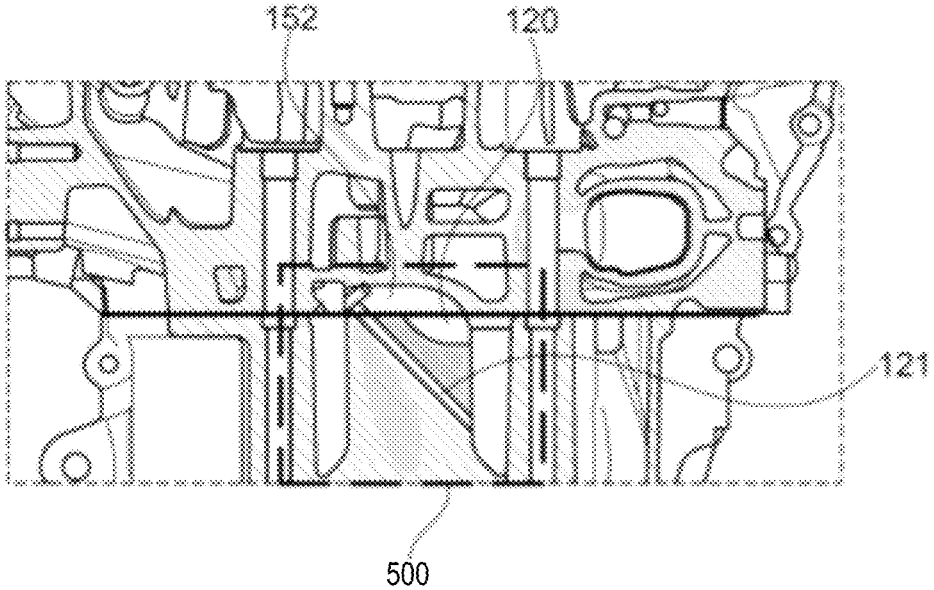
FIG. 5A shows a front view of a sectional illustration with temperature profile of the first exemplary embodiment of an assembly according to the disclosure.
Figure 5B:
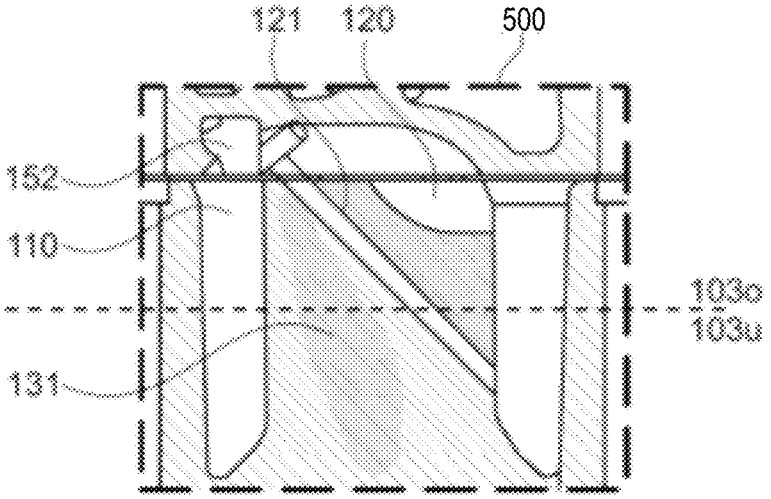
FIG. 5B shows an enlarged detail from FIG. 5*a*.

A more uniform lowering of the temperature in the cylinder bridge 103 is via the arrangement of the coolant channels 120, 121 illustrated in FIG. 5*a*. FIG. 5*b* shows an enlarged detail 500 from FIG. 5*a*. Here, too, the cylinder bridge 103 can be divided, on the basis of the imaginary plane depicted by way of example, into an upper region 103*o* and a lower region 103*u*. The second coolant channel 121 runs both through the upper region 103*o* and through the lower region 103*u* of the cylinder bridge 103. Additionally, the cylinder bridge 103 and the cylinders 101 are cooled from above via the arrangement of the coolant manifold 152 at the top side 103*a* of the cylinder bridge 103. A hotspot 130 below the cooling slots (cf. FIG. 4*b*) may be avoided entirely via the arrangement of the second coolant channel 121 in the lower region 103*u*. This principle cools the cylinder bridge 103 and the adjoining cylinder 101 over a large area or a large volume. It is desired to accept only a temperature elevation 131 of the metal or aluminum of for example 160° C. in the lower region 103*u*. In this way, enhanced cooling of the cylinder bridge 103 and the adjacent cylinder liners 104 (if present) or the cylinders 101 is achieved.

FIGS. 1-2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

In this way, cooling at a cylinder bridge between two adjacent cylinders is enhanced via a first coolant channel and a second coolant channel. Each of the first coolant channel and the second coolant channel receive coolant from a coolant jacket, wherein coolant flows separately through the first coolant channel and the second coolant channel to a coolant manifold arranged in the head. The technical effect of separating coolant flows through the first coolant channel and the second coolant channel is to reduce manufacturing costs and to enhance cooling. By shaping the first coolant channel differently than the second coolant channel, enhanced cooling may be provided over a greater area of the cylinder bridge.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An assembly, comprising:

a cylinder head and a cylinder block of an internal combustion engine of a motor vehicle, wherein the cylinder head and the cylinder block jointly form two or more cylinders, which are at least partially cooled via coolant in a cooling jacket arranged in the cylinder block of the internal combustion engine, wherein the cylinders each comprise an upper region arranged in the cylinder head and the cylinder block and a lower region situated below the upper region in the cylinder block; and a cylinder bridge arranged directly between two cylinders, wherein a first coolant channel is arranged in the upper region and a second coolant channel is arranged separately from the first coolant channel in the lower region, wherein the first coolant channel directs coolant from only the upper region directly to a portion of a coolant manifold arranged in the cylinder head directly between adjacent cylinders of the two or more cylinders, and wherein the second coolant channel directs coolant from only the lower region direct to a portion of the coolant manifold outside of a space between two adjacent cylinders.

2. The assembly of claim 1, wherein the first coolant channel fluidly couples an upper region of the cooling jacket to the coolant manifold and the second coolant channel fluidly couples a lower region of the cooling jacket to the coolant manifold, wherein the upper region is vertically higher than the lower region relative to a direction of gravity.

3. The assembly of claim 2, wherein each cylinder of the two or more cylinders comprises a cylinder axis which corresponds to a central axis of a cylinder, wherein a first inlet of the first coolant channel and a second inlet of the second coolant channel are arranged along a line, wherein the line is oriented parallel to the cylinder axis.

4. The assembly of claim 1, wherein the second coolant channel is shaped as an obliquely inclined passage bore.

5. The assembly of claim 1, wherein the first coolant channel is shaped as an obliquely inclined passage bore.

6. The assembly of claim 1, wherein the first coolant channel is more curved than the second coolant channel.

7. The assembly of claim 1, wherein the cylinder block comprises only aluminum.

8. The assembly of claim 1, wherein the two or more cylinders are free of a cylinder liner.

9. An engine, comprising:

a cylinder head and a cylinder block shaping a plurality of cylinders;

a cylinder bridge is arranged between directly adjacent cylinders of the plurality of cylinders, wherein the cylinder bridge comprises a first coolant channel and a second coolant channel, wherein the first coolant channel extends from an upper region of the cylinder bridge to a portion of a coolant manifold directly between adjacent cylinders in the cylinder head, and wherein the second coolant channel extends from a lower region of the cylinder bridge to a portion of the coolant manifold outside of a space directly between adjacent cylinders.

10. The engine of claim 9, wherein the first coolant channel and the second coolant channel fluidly couple a coolant jacket to the coolant manifold.

11. The engine of claim 9, wherein the first coolant channel and the second coolant channel are completely separate, and wherein coolant in the first coolant channel does not mix with coolant in the second coolant channel.

12. The engine of claim 9, wherein a length of the first coolant channel is less than a length of the second coolant channel.

13. The engine of claim 9, wherein a curvature of the first coolant channel is greater than a curvature of the second coolant channel.

14. The engine of claim 9, wherein a first coolant channel angle of the first coolant channel is less than a second coolant channel angle of the second coolant channel, wherein the first coolant channel angle and the second coolant channel angle are measured relative to a central cylinder axis.

15. The engine of claim 9, wherein the second coolant channel delivers coolant to a more distal portion of the cylinder bridge than the first coolant channel relative to a coolant jacket.

16. The engine of claim 15, wherein the first coolant channel and the second coolant channel receive coolant from the coolant jacket along an axis parallel to a cylinder axis, and wherein the first coolant channel receives coolant from a vertically higher portion of the coolant jacket than the second coolant channel.

17. An engine system, comprising:

a cylinder head and a cylinder block shaping a plurality of cylinders;

a cylinder bridge is arranged between directly adjacent cylinders of the plurality of cylinders, wherein the cylinder bridge comprises a first coolant channel and a second coolant channel, wherein the first coolant channel extends from only an upper region of the cylinder bridge to a portion of a coolant manifold directly between adjacent cylinders, and wherein the second coolant channel extends from a lower region of the cylinder bridge to a portion of the coolant manifold outside of a space between adjacent cylinders, and wherein a length of the first coolant channel is less than a length of the second coolant channel.

18. The engine system of claim 17, wherein the first coolant channel and the second coolant channel conduct coolant in a direction at least partially opposite gravity.

19. The engine system of claim 17, wherein the plurality of cylinders comprises a cylinder liner.

* * * * *